US010221597B2

(12) United States Patent
Hammerer

(10) Patent No.: US 10,221,597 B2
(45) Date of Patent: Mar. 5, 2019

(54) FURNITURE HINGE

(71) Applicant: Julius Blum GmbH, Hoechst (AT)

(72) Inventor: André Hammerer, Alberschwende (AT)

(73) Assignee: Julius Blum GmbH, Hoechst (AT)

( * ) Notice: Subject to any disclaimer, the term of this patent is extended or adjusted under 35 U.S.C. 154(b) by 28 days.

(21) Appl. No.: 15/590,630

(22) Filed: May 9, 2017

(65) Prior Publication Data

US 2017/0241175 A1 Aug. 24, 2017

Related U.S. Application Data

(63) Continuation of application No. PCT/AT2015/000130, filed on Oct. 9, 2015.

(30) Foreign Application Priority Data

Dec. 9, 2014 (AT) ..... A 881/2014

(51) Int. Cl.
*E05D 3/14* (2006.01)
*E05D 3/16* (2006.01)
(Continued)

(52) U.S. Cl.
CPC ..... *E05D 3/142* (2013.01); *E05D 3/16* (2013.01); *E05D 11/1021* (2013.01);
(Continued)

(58) Field of Classification Search
CPC ..... E05D 3/142; E05D 3/16; E05D 11/02; E05D 11/04; E05D 11/1021;
(Continued)

(56) References Cited

U.S. PATENT DOCUMENTS 3,975,791 A * 8/1976 Hettich ..... E05F 5/006 16/294
4,083,082 A * 4/1978 Holmes ..... E05D 3/142 16/288
(Continued)

FOREIGN PATENT DOCUMENTS

AT 005 290 5/2002
AT 007 571 5/2005
(Continued)

OTHER PUBLICATIONS

English translation of Chinese Search Report dated Jan. 17, 2018 in Chinese Application No. 201580066640.5.
(Continued)

*Primary Examiner* — Roberta S Delisle
(74) *Attorney, Agent, or Firm* — Wenderoth, Lind & Ponack, L.L.P.

(57) ABSTRACT

A furniture hinge for pivotally connecting at least two furniture parts to one another includes at least two fastening portions pivotally connected to one another for fastening to the furniture parts, and the fastening portions can be moved relative to each other between a closed position and an open position. A spring device presses the fastening portions into the closed position and/or into the open position, and a damping device dampens a relative movement of the fastening portions. The spring device is integrated into the damping device, and the damping device and the spring device are accommodated within a first and within a second housing portion. The first and second housing portions are displaceably arranged relative to one another for performing the relative movement.

17 Claims, 5 Drawing Sheets

(51) Int. Cl.

| | |
|---|---|
| ***E05F 1/12*** | (2006.01) |
| ***E05F 5/00*** | (2017.01) |
| ***E05D 11/10*** | (2006.01) |
| *E05D 3/06* | (2006.01) |
| *E05D 15/58* | (2006.01) |
| *E05F 1/08* | (2006.01) |

(52) U.S. Cl.
CPC ..... *E05F 1/1253* (2013.01); *E05F 5/006* (2013.01); *E05D 3/06* (2013.01); *E05D 3/14* (2013.01); *E05D 11/10* (2013.01); *E05D 15/58* (2013.01); *E05F 1/08* (2013.01); *E05Y 2600/46* (2013.01); *E05Y 2800/205* (2013.01); *E05Y 2800/24* (2013.01); *E05Y 2900/20* (2013.01)

(58) Field of Classification Search
CPC ..... E05D 2011/045; E05D 3/14; E05F 1/08; E05F 1/1253; E05F 5/006
USPC ..... 16/273–274, 277, 285, 287, 288
See application file for complete search history.

(56) References Cited

U.S. PATENT DOCUMENTS

| | | | | |
|---|---|---|---|---|
| 4,184,228 | A * | 1/1980 | Lautenschlager | E05D 3/142 16/294 |
| 6,327,457 | B1 | 12/2001 | Hashimoto | |
| 7,574,775 | B2 * | 8/2009 | Zetti | E05D 3/16 16/266 |
| 8,205,298 | B2 * | 6/2012 | Lin | E05F 5/006 16/245 |
| 8,225,459 | B2 | 7/2012 | Waltemate et al. | |
| 8,601,644 | B1 * | 12/2013 | Chen | E05F 5/006 16/286 |
| 8,713,760 | B2 * | 5/2014 | Krudener | E05D 3/16 16/370 |
| 9,359,801 | B2 | 6/2016 | Weber | |
| 2003/0159249 | A1 * | 8/2003 | Tsung-Lung | E05D 3/16 16/371 |
| 2004/0040118 | A1 | 3/2004 | Han et al. | |
| 2005/0015927 | A1 | 1/2005 | Kropf | |
| 2005/0155180 | A1 * | 7/2005 | Lin | E05D 11/1021 16/287 |
| 2007/0251058 | A1 | 11/2007 | Fitz et al. | |
| 2010/0101052 | A1 | 4/2010 | Waltemate et al. | |
| 2012/0085036 | A1 | 4/2012 | Nishida et al. | |
| 2012/0096679 | A1 | 4/2012 | Weber | |
| 2013/0145580 | A1 | 6/2013 | Brunnmayr | |
| 2013/0239363 | A1 * | 9/2013 | Apur | E05F 5/006 16/50 |
| 2014/0201947 | A1 * | 7/2014 | Oshima | E05D 7/086 16/319 |
| 2015/0330128 | A1 * | 11/2015 | Ng | E05D 3/16 16/65 |

FOREIGN PATENT DOCUMENTS

| | | |
|---|---|---|
| AT | 413 728 | 5/2006 |
| AU | 2007291476 | 7/2007 |
| CN | 101512088 | 8/2009 |
| CN | 103025987 | 4/2013 |
| DE | 20 2007 004 621 | 9/2008 |
| DE | 20 2005 021 892 | 1/2011 |
| EP | 2 336 467 | 6/2011 |
| JP | 2003-134283 | 5/2003 |
| JP | 2006-133532 | 5/2006 |
| JP | 2008-504477 | 2/2008 |
| JP | 2009-115928 | 5/2009 |
| JP | 2013-137555 | 7/2013 |
| WO | 2006/059860 | 6/2006 |
| WO | 2010/124946 | 11/2010 |

OTHER PUBLICATIONS

International Search Report dated Jan. 12, 2016 in International (PCT) Application No. PCT/AT2015/000130.

* cited by examiner

FURNITURE HINGE

BACKGROUND OF THE INVENTION

The present invention relates to a furniture hinge for pivotally connecting at least two furniture parts to one another. The furniture hinge includes at least two fastening portions pivotally connected to one another for fastening to the furniture parts, wherein the fastening portions can be moved relative to each other between a closed position and an open position. The furniture hinge also includes a spring device for pressing the fastening portions into the closed position and/or into the open position, and a damping device for dampening a relative movement of the fastening portions, wherein the spring device is integrated into the damping device.

WO 2010/124946 A1 shows a damping device for furniture hinges, wherein a piston is displaceably arranged within an inner space of a housing. For applying a pressure to the piston, a piston rod is provided which protrudes out of the housing and which is coupled via a connecting element to a hinge pin of a furniture hinge. Upon a movement of the hinge, the piston rod thus is being pressed-in by way of the moving hinge pin, so that the movement of the hinge takes place in a dampened manner. In order to press the furniture hinge into the fully closed position, a spring-assisted closing mechanism (which is not shown in WO 2010/124946 A1) needs to be provided. However, the additional arrangement of such a closing mechanism would result in an increased installation space and an additional installation effort.

Hinge fittings, in which the spring device and the damping device are in each case integrated into a common structural unit, are described, for example, in AT 5290 U1, EP 2 336 467 A1, AT 413 728 B, U.S. Pat. No. 6,327,457 B1 and in US 2004/0040118 A1.

SUMMARY OF THE INVENTION

It is an object of the present invention to provide a furniture hinge of the type mentioned in the introductory part, having a more compact structure.

According to the invention, the damping device and the spring device are accommodated within a first and a second housing portion, and the first and the second housing portions, for performing the relative movement, are displaceably arranged relative to one another.

In this way, a very compact design of the furniture hinge is effected, because the two housing portions, when the relative movement of the fastening portions is performed, can be linearly displaced along a predetermined direction of movement, and no veering movements of the housing portions occur.

Preferably, the first housing portion and the second housing portion are tensioned relative to one another by the force of the spring device. For example, the housing portions are tensioned in such a way that the first housing portion and the second housing portion can be compressed relative to one another against the force of the spring device.

The spring device for moving the furniture hinge into the end position(s), together with the damping device for dampening a hinge movement, are jointly accommodated within a common functional constructional unit. Therefore, the furniture hinge can be equipped both with a closing mechanism and a damping function by the installation of a single, compact structural unit. The constructional unit can also be retrofitted to already existing furniture hinges. In this way, a separate arrangement or attachment of a spring device and an additional damping device on the furniture hinge can be omitted.

The force of the spring device is naturally to be dimensioned in such a way that the furniture hinge can be reliably pressed by the spring force into the fully closed and/or into the fully open position. The spring device can include, for example, at least one helical spring, preferably a compression spring. Alternatively, a tension spring, a torsion spring, or a leaf spring may also be provided.

The damping device can include at least one, preferably hydraulic, linear damper. Such linear dampers usually have a piston-cylinder-unit, wherein a relative movement between the cylinder and the piston can be dampened by a, in particular hydraulic, damping medium. Instead of a linear damper, a rotational damper with two damping components being rotatable to one another may also be provided.

BRIEF DESCRIPTION OF THE DRAWINGS

Further details and advantages of the present invention result from the following description of figures in which.

DETAILED DESCRIPTION OF THE INVENTION

Figure 1:
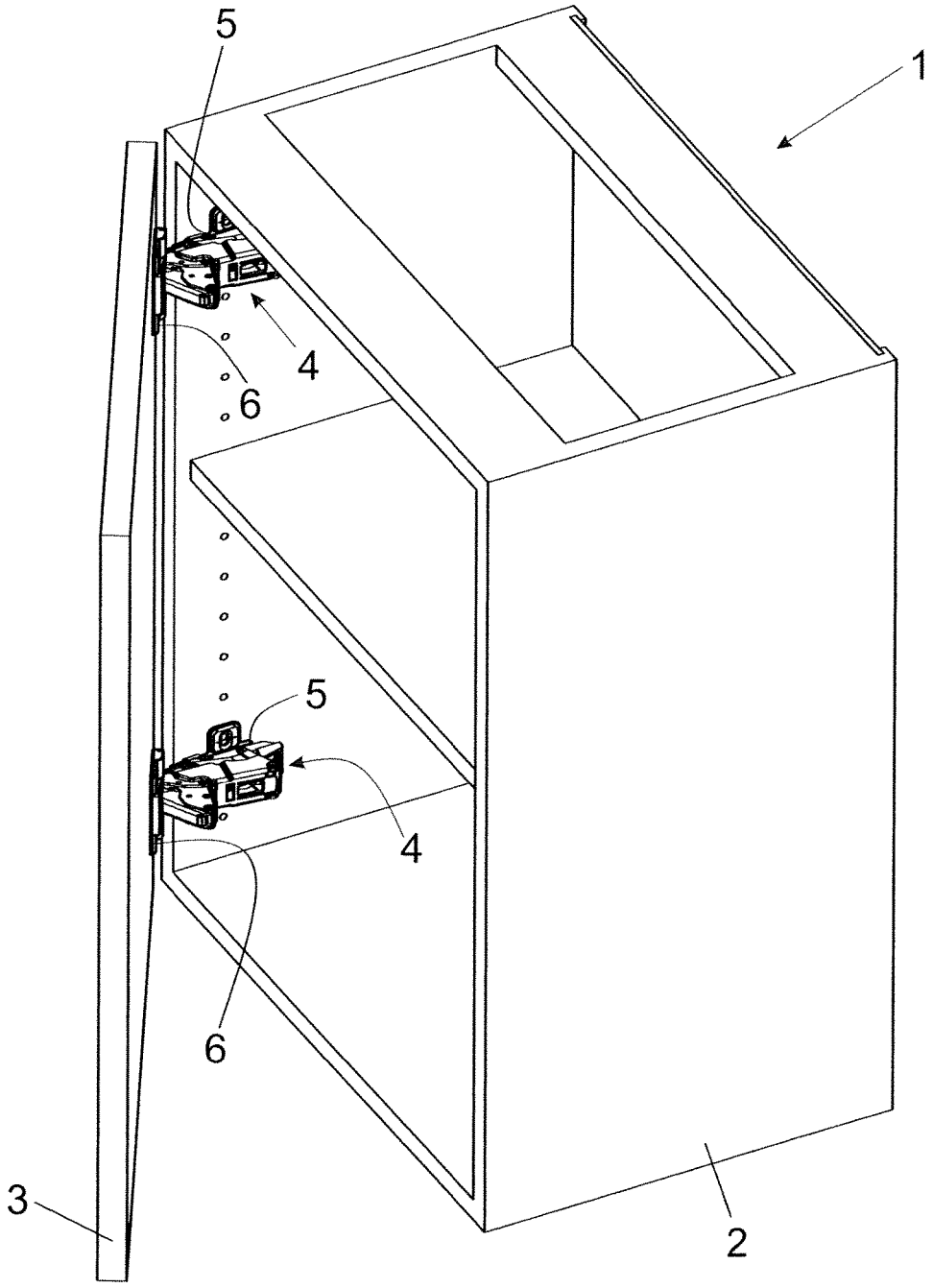
FIG. 1 is a perspective view of an item of furniture having a furniture carcass and a furniture part being movable thereto.

FIG. 1 shows an item of furniture 1 with a furniture carcass 2 in a perspective view, wherein a movable furniture part 3 in the form of a door is pivotally supported about a verticallyextending axis relative to the furniture carcass 2 by furniture hinges 4. The furniture hinges 4 each have a first fastening portion 5 with a hinge arm 5*a* (FIG. 2*a*) to be fixed to the furniture carcass 2 and a second fastening portion 6 with a hinge cup 6*a* (FIG. 2*a*) to be fixed to the movable furniture part 3. The hinge cup 6*a*, as commonly known, can be countersunk in a cylindrical bore provided in the movable furniture part 3, and is pivotally connected to the first fastening portion 5 by a joint mechanism.

Figure 2A:
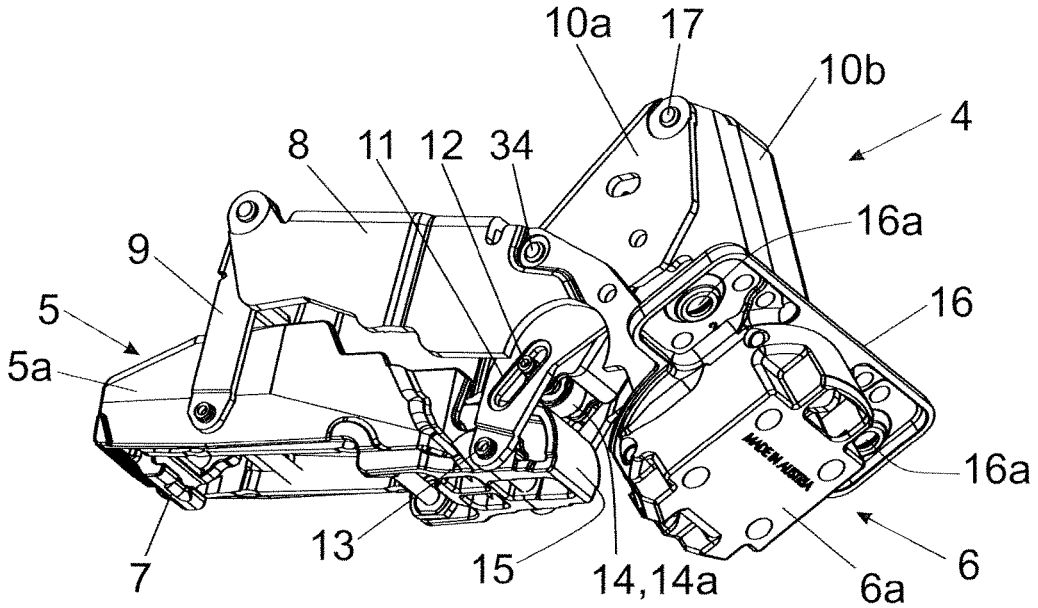
FIGS. 2*a*, 2*b* are perspective views of a furniture hinge and an enlarged detail view thereof.
Figure 2B:
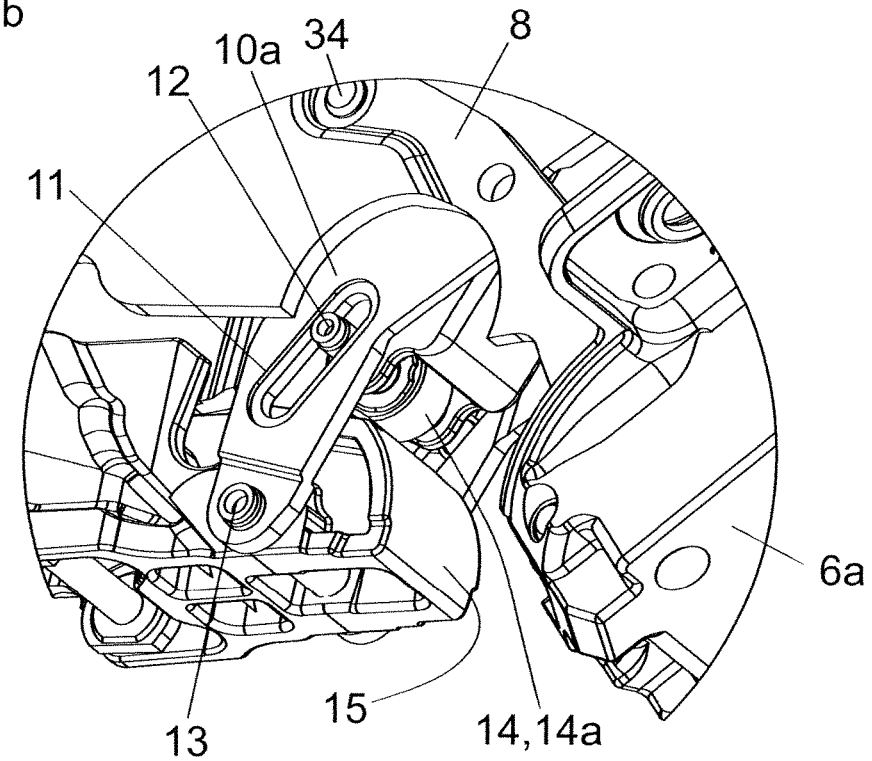
Figure 3:
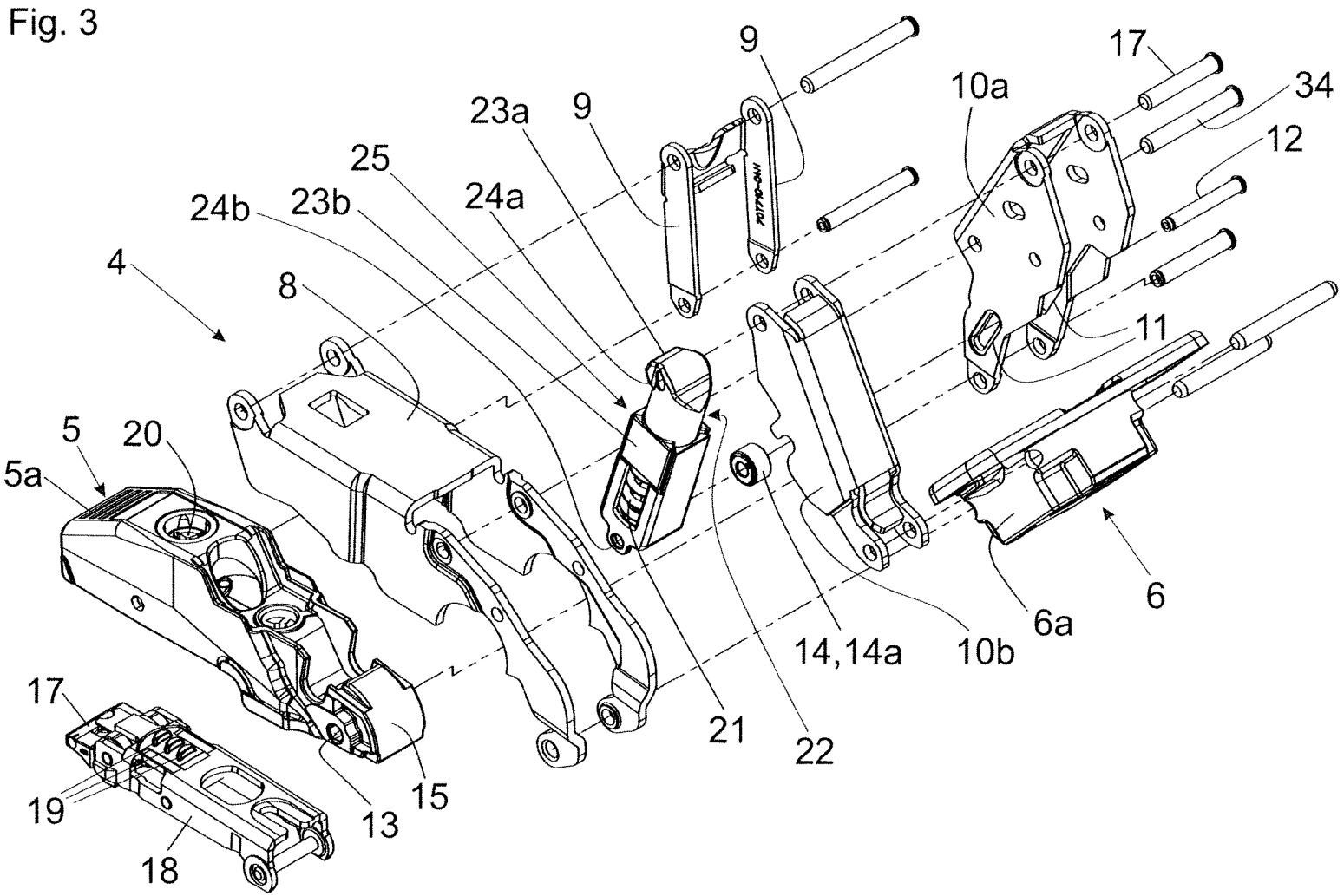
FIG. 3 is an exploded view of the furniture hinge according to FIGS. 2*a*, 2*b*, FIGS. 4*a*-4*d* show the closing process of the furniture hinge in temporal sequences.

FIG. 2*a* shows the furniture hinge 4 in a perspective view. The furniture hinge 4 includes a first fastening portion 5 with a hinge arm 5*a* which can be releasably latched by a spring-loaded latching lever 7 onto a mounting plate to be fixed to the furniture carcass 2. A second fastening portion 6 with a hinge cup 6*a* to be countersunk in a cylindrical bore of the furniture part 3 is connected to the hinge arm 5*a* by a joint mechanism. The hinge cup 6*a* can be fixed to the movable furniture part 3 by a flange 16 which has openings 16*a* for the passage of screws. In the shown embodiment, the furniture hinge 4 is configured as a wide-angle hinge having a maximum opening angle of approximately 170°. For this purpose, an intermediate piece 8 which is motionally coupled to a hinge movement is provided. The intermediate piece 8 has a first end pivotally connected to the hinge arm 5*a* by levers 9, and has a second end pivotally connected to the hinge cup 6*a*. The joint mechanism further includes two hinged levers 10*a* and 10*b* which are connected to one another by a hinged pin 17. The first hinged lever 10*a* is pivotally connected via a pivoting axis 13 to the hinge arm 5*a* and, moreover, is pivotally connected via a further pivoting axis 34 to the intermediate piece 8. The second hinged lever 10*b* is pivotally coupled to the hinge cup 6*a*. The first hinged lever 10*a* has a guide 11 (preferably a slotted recess) for allowing limited displacement of a bolt 12 on which a pressure portion 14 (preferably a pressure roller 14*a* which pivotally supported about the bolt 12) is arranged. The pressure portion 14 in the form of the pressure roller 14*a* can be moved by movement of the hinge 4, at least over a region along a setting contour 15. In the shown embodiment, the setting contour 15 is arranged or formed on the hinge arm 5*a*. The pressure portion 14 in the form of the pressure roller 14*a* forms part of a common structural unit 25 (FIG. 3) by which the furniture hinge 4 can be moved into the fully closed position and/or fully open position by the force of a spring device 21 (FIG. 3), and additionally a movement of the furniture hinge 4 into the closed position and/or open position can be dampened by a damping device 22 (FIG. 3). By the choice of the respective geometry of the setting contour 15, the operating start, the progression, the end of the spring force, and the damping force can be determined in various configurations. FIG. 2*b* shows an enlarged detail view of the furniture hinge 4 according to FIG. 2*a*.

FIG. 3 shows the furniture hinge 4 in an exploded view. The fastening portion 5 with the hinge arm 5*a* can be connected to a base plate 18, and the hinge arm 5*a* can be adjusted relative to the base plate 18 in a longitudinal direction of the base plate 18 by a rotation of an adjusting wheel 20 which interacts with protrusions 19 of the base plate 18. The intermediate piece 8, which serves as a sort of extension for the hinge arm 5*a* for obtaining a greater opening angle of the furniture hinge 4 towards an open position, has a first end pivotally connected via levers 9 to the hinge arm 5*a*, and has a second end hingedly connected to the hinge cup 6*a*. The first hinged lever 10*a* is pivotally mounted about the pivoting axis 13 relative to the hinge arm 5*a*, and is connected via a hinged pin 17 to the second hinged lever 10*b*. The other end of the second hinged lever 10*b* is hingedly connected to the hinge cup 6*a*.

A spring device 21—which preferably includes at least one compression spring—for moving the furniture hinge 4 into the fully closed position and/or open position, and additionally a damping device 22 for dampening a movement of the furniture hinge 4 are accommodated within a common structural unit 25. The common structural unit 25 includes two housing portions 23*a* and 23*b* which are displaceable relative to one another, and which are configured to be compressible to one another against the force of the spring device 21. The first housing portion 23*a* has a holder 24*a* for accommodating a hinged pin 17 which pivotally connects the two hinged levers 10*a*, 10*b* to one another. The second housing portion 23*b* includes a further holder 24*b* for accommodating the bolt 12 on which the pressure portion 14 in the form of the pressure roller 14*a* is supported. The holders 24*a*, 24*b* are each configured so as to entirely embrace the cylindrical hinged pin 17 and the bolt 12, respectively. However, the holders 24*a*, 24*b* may also be configured to be clamp-like, so that the holders 24*a*, 24*b* only partially embrace the hinged pin 17 and the bolt 12, respectively. In this way, the common structural unit 25 can be replaced in case of a defect or can be retrofitted. The common structural unit 25 with the damping device 22 and the spring device 21 integrated therein thus interacts, on the one hand, with the hinged pin 17 and, on the other hand, via the pressure roller 14*a*, with the setting contour 15 of the hinge arm 5*a*. Upon a movement of the furniture hinge 4, the hinged pin 17—together with the pressure portion 14—can be displaced along a guide 11 of the first hinged lever 10*a*. By this hinge movement, the first housing portion 23*a* is displaceable, preferably telescopically, relative to the second housing portion 23*b*. Thus, an acceleration of the fastening portions 5, 6 relative to one another, caused by the spring device 21, can be dampened by the damping device 22.

Figure 4A:
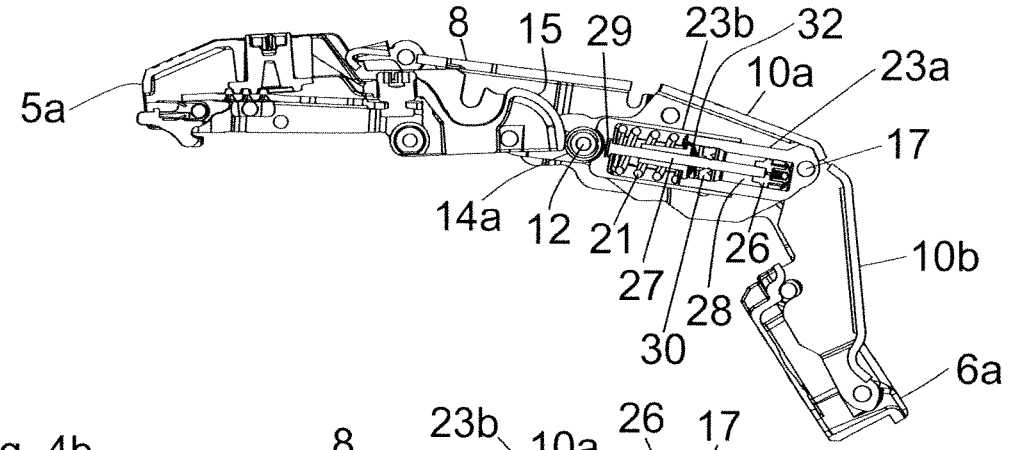

FIG. 4*a*-4*d* show the furniture hinge 4 in different positions of the fastening portions 5, 6 relative to one another. In FIG. 4*a*, the fully open position (approximately 170°) of the furniture hinge 4 is depicted, wherein the intermediate piece 8 and the two hinged levers 10*a*, 10*b* are in a fully stretched position. Visible is the common structural unit 25 (FIG. 3) in which the spring device 21 and the damping device 22 are jointly accommodated. The first housing portion 23*a* is supported on a hinged pin 17 which is motionally coupled to a movement of the hinge 4 and which engages telescopically into the second housing portion 23*b*. The first and second housing portions 23*a*, 23*b* are tensioned relative to one another by the force of the spring device 21. Within the first housing portion 23*a*, at least one fluid chamber 28 is formed in which a piston 26 is displaceably supported. A piston rod 27 connected to the piston 26 passes through the second housing portion 23*b* and is fixed to a stop 29 of the second housing portion 23*b*. The second housing portion 23*b* has a bolt 12 for pivotally supporting the pressure roller 14*a* which runs along a setting contour 15 being arranged on the hinge arm 5*a*. As shown in FIG. 4*a*, the piston 26 is fully pressed into the first housing portion 23*a* and is located in a ready position for the damping stroke, and the damping device 22 therefore reacts on tensile force. The setting contour 15, over a large region of the closing path, can be formed such that the section of the setting contour 15, which contacts the pressure roller 14*a*, runs equidistantly relative to the hinged pin 17. In other words, the setting contour 15 is configured so that there is no relative movement between the piston 26 and the fluid chamber 28 upon a large part of the closing path of the furniture hinge 4, so that also no damping action is being generated.

Figure 4B:
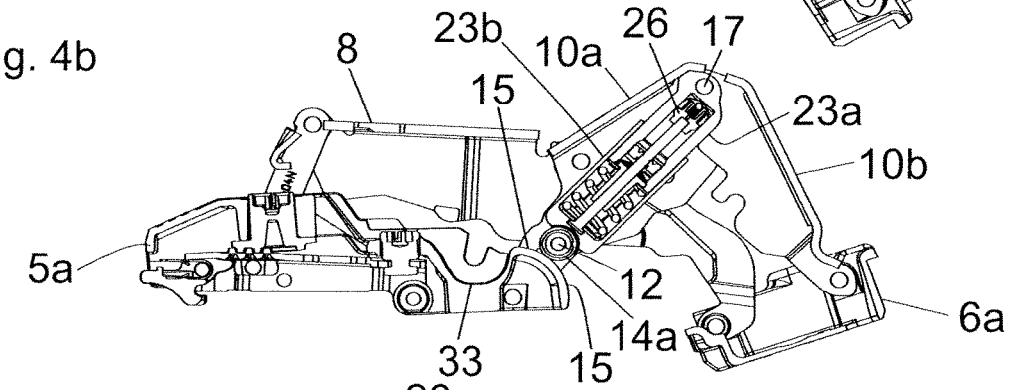

FIG. 4*b* shows the furniture hinge 4 with a further reduced opening angle in comparison to FIG. 4*a*. The pressure roller 14 runs along the setting contour 15 of the hinge arm 5*a*, and there is no relative movement between the piston 26 and the fluid chamber 28 and thus no damping action occurs.

Figure 4C:
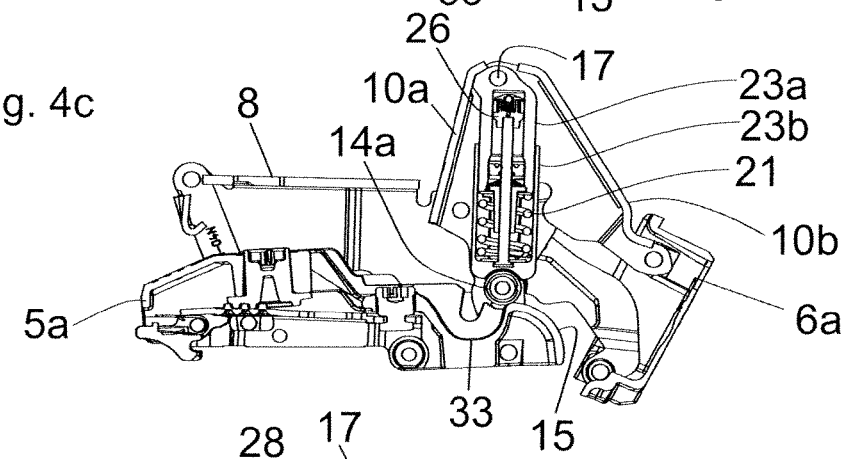
Figure 4D:
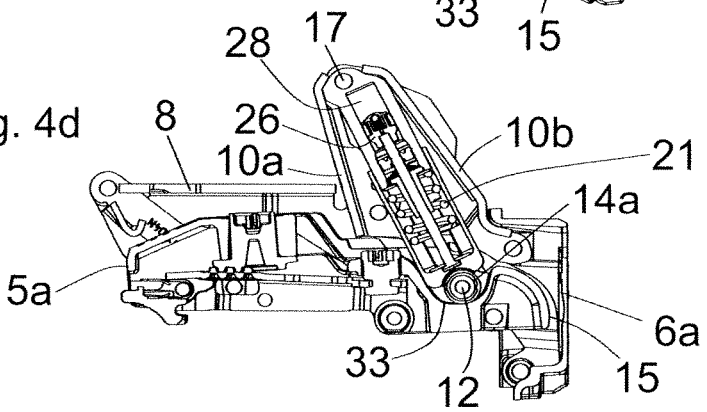

FIG. 4*c* shows the furniture hinge 4 with a smaller opening angle in comparison to FIG. 4*b*. In the last closing region, the pressure roller 14*a* interacts with a trough-shaped section 33 of the setting contour 15, and the trough-shaped section 33 has a greater relative spacing in relation to the hinged pin 17. When now the pressure roller 14*a* reaches into the trough-shaped section 33, the two housing portions 23*a*, 23*b* are pressed apart by the force of the relaxing spring device 21 so that the furniture hinge 4 is pressed by the force of the spring device 21 into the fully closed position. The piston 26 (the piston rod 27 of which is fixed to the second housing portion 23*b*) is pulled-out of the fluid chamber 28 of the first housing portion 23*a* and is thereby dampened by a resistance of a damping fluid (for example silicone oil) arranged within the fluid chamber 28. By way of this braking action of the piston 26, a movement of the furniture hinge 4 into the closed end position can also be dampened. In FIG. 4*d*, the furniture hinge 4 is in the fully closed position. In the event that the furniture hinge 4 is pressed into the fully open position by the force of the spring device 21, such a trough-shaped recess 33 of the setting contour 15 needs to also be arranged in that region in which the pressure roller

14*a*, according to the position shown in FIG. 4*a*, interacts with the setting contour 15. Besides the force progression acting on the furniture hinge 4, the setting contour 15 also determines at the same time the transmission ratio of the damping device 22.

Figure 5A:
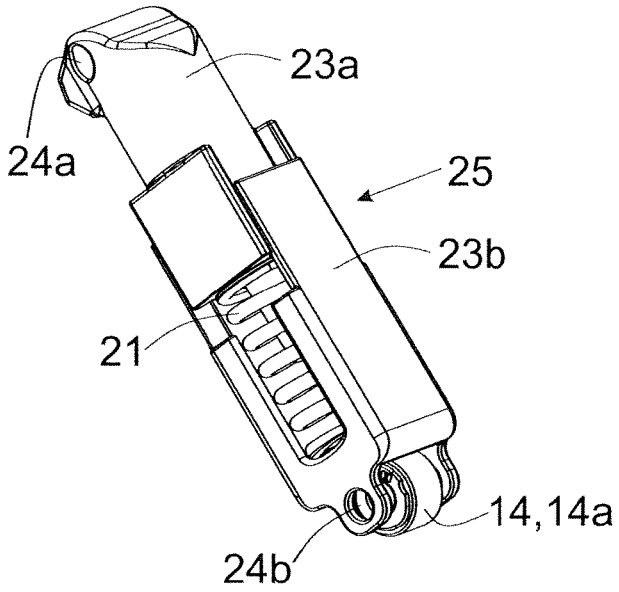
FIGS. 5*a*-5*c* show the common structural unit in different views.

FIG. 5*a* shows the common structural unit 25 in a perspective view. The damping device 22 is accommodated within the first housing portion 23*a*, while the spring device 21 is accommodated within the second housing portion 23*b*. The two housing portions 23*a*, 23*b* can be compressed to each other against the force of the spring device 21. The holder 24*a* is provided for accommodating the hinged pin 17 of the furniture hinge 4, while the holder 24*b* is provided for supporting the pressure portion 14 in the form of the pressure roller 14*a*.

Figure 5B:
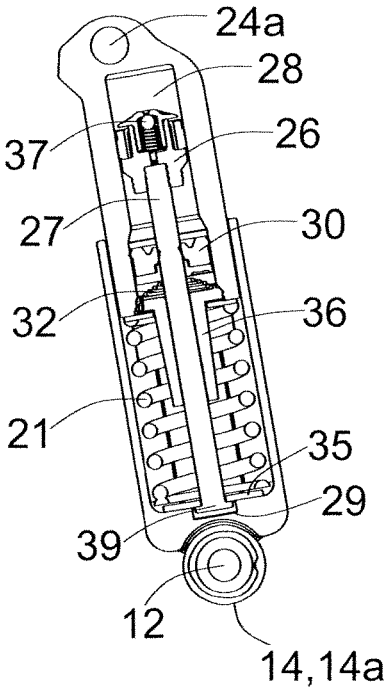

FIG. 5*b* shows the common structural unit 25 in a cross-section. Within the first housing portion 23*a*, at least one fluid chamber 28 is arranged in which a linearly displaceable piston 26 is disposed. The piston 26 is equipped with an overload protection device 37 having a spring-loaded ball which, upon an unduly large application of pressure acting on the piston 26, releases an overload channel of the piston 26 and therewith enables a rapid pressure reduction. The piston rod 27 connected to the piston 26 is passed through the second housing portion 23*b* and is attached to a stop 29 of the second housing portion 23*b*. The attachment of the piston rod 27 to the stop 29 is effected by a widened head 39 of the piston rod 27 which is held on the stop 29 by a disc 35 and by the force of the spring device 21 in the form of a compression spring. The fluid chamber 28 is closed in a fluid-tight manner by a cap 36 which serves at the same time as a guide or support for the spring device 21. A limitedly movable seal 30 and a volume compensation device with a compensation spring 32 is arranged in the fluid chamber 28, and the compensation spring 32 takes up the different volume emerging from the displacement of the piston rod 27 by deformation.

Figure 5C:
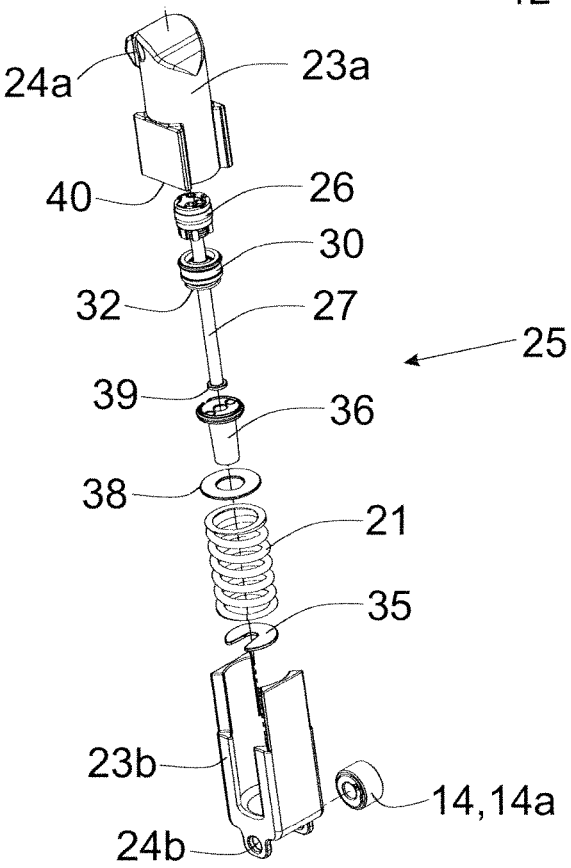

FIG. 5*c* shows the common structural unit 25 in an exploded view. The widened head 39 of the piston rod 27 is being held by a disc 35 and by the force of the spring device 21 to the stop 29 (FIG. 5*b*) of the second housing portion 23*b*. The other end of the spring device 21 presses against a ring-shaped support disc 38 which rests against a front face 40 of the first housing portion 23*a*, so that the housing portions 23*a* and 23*b* can be compressed relative to one another against the force of the spring device 21.

The invention claimed is:

1. A furniture hinge for pivotally connecting at least two furniture parts to one another, including:

at least two fastening portions which are pivotally connected to one another for fastening to the furniture parts, wherein the fastening portions can be moved relative to each other between a closed position and an open position, a spring device for pressing the fastening portions into the closed position and/or into the open position, and a damping device for dampening a relative movement of the fastening portions, wherein the spring device is integrated into the damping device, wherein the damping device and the spring device are accommodated within a first housing portion and within a second housing portion, respectively, wherein the first housing portion and the second housing portion are displaceably arranged relative to one another for performing the relative movement, and wherein a fluid chamber is formed within the first housing portion, a piston being displaceably arranged within the fluid chamber.

2. The furniture hinge according to claim 1, wherein the damping device includes a linear damper.

3. The furniture hinge according to claim 2, wherein the linear damper is a hydraulic linear damper.

4. The furniture hinge according to claim 1, wherein the spring device includes at least one helical spring.

5. The furniture hinge according to claim 4, wherein the helical spring is a compression spring.

6. The furniture hinge according to claim 1, wherein the first housing portion and the second housing portion are tensioned relative to each other by the force of the spring device.

7. The furniture hinge according to claim 1, wherein the piston is connected to a piston rod, the free end of the piston rod is fixed to a stop of the second housing portion.

8. The furniture hinge according to claim 1, wherein the first housing portion has a holder for accommodating a hinged pin of the furniture hinge.

9. The furniture hinge according to claim 8, wherein the holder embraces the hinged pin.

10. The furniture hinge according to claim 9, wherein the holder entirely embraces the hinged pin.

11. The furniture hinge according to claim 8, wherein the hinged pin pivotally connects a first hinged lever and a second hinged lever of the furniture hinge to one another.

12. The furniture hinge according to claim 11, wherein the first hinged lever is pivotally connected to an intermediate piece, the intermediate piece being permanently operatively coupled to a movement of the furniture hinge, and the second hinged lever being pivotally connected to one of the at least two fastening portions.

13. The furniture hinge according to claim 1, wherein the first fastening portion includes a hinge arm, and the second fastening portion includes a hinge cup.

14. A furniture hinge for pivotally connecting at least two furniture parts to one another, the furniture hinge comprising:

at least two fastening portions which are pivotally connected to one another for fastening to the furniture parts, wherein the fastening portions can be moved relative to each other between a closed position and an open position, a spring device for pressing the fastening portions into the closed position and/or into the open position, and a damping device for dampening a relative movement of the fastening portions, wherein the spring device is integrated into the damping device, wherein the damping device and the spring device are accommodated within a first housing portion and within a second housing portion, respectively, wherein the first housing portion and the second housing portion are displaceably arranged relative to one another for performing the relative movement, and wherein the second housing portion includes a pressure portion, wherein the pressure portion is movable at least over a region along a setting contour upon a relative movement of the fastening portions to one another.

15. The furniture hinge according to claim 14, wherein the setting contour is arranged or formed on one of the at least two fastening portions.

16. The furniture hinge according to claim 14, wherein the pressure portion is arranged on a bolt, the bolt being displaceably guided along a guide of a hinged lever upon a movement of the furniture hinge.

17. The furniture hinge according to claim 14, wherein the pressure portion is a pressure roller.

* * * * *